United States Patent [19]

Low

[11] Patent Number: 4,672,224

[45] Date of Patent: Jun. 9, 1987

[54] COMPOSITE AUTOMATIC CONTROL SYSTEM FOR VEHICLE ENGINE WITH THEFT PREVENTION CIRCUIT

[76] Inventor: Shy-Kong Low, 397, Jong-Shin Rd., Shin-Wu Shiang, Taiwan

[21] Appl. No.: 714,038

[22] Filed: Mar. 20, 1985

[51] Int. Cl.[4] ..... H01H 47/00

[52] U.S. Cl. ..... 307/10 AT; 307/10 R; 361/172; 340/64; 70/278

[58] Field of Search ..... 307/10 AT, 10 R, 9; 361/171, 172, 173, 190, 191, 192, 193, 194, 195, 196; 340/63, 64, 65, 52 H, 52 R, 274 C, 52 F; 70/277, 278, 240, 241, 256, 289, 258, 252, 241, 237, 238, 239; 123/179 BG, 146.5 B, 179 K, 179 L; 200/61.47, 61.52; 180/167

[56] References Cited

U.S. PATENT DOCUMENTS

| | | | |
|---|---|---|---|
| 3,610,943 | 10/1971 | Jones | 361/172 X |
| 3,662,229 | 5/1972 | Graff et al. | 361/179 |
| 3,751,718 | 8/1973 | Hanchett | 361/172 |
| 3,784,839 | 1/1974 | Weber | 307/10 AT |
| 3,831,065 | 8/1974 | Martin et al. | 70/278 X |
| 4,205,300 | 5/1980 | Ho et al. | 307/10 AT X |
| 4,291,237 | 9/1981 | Kitano | 340/64 X |
| 4,446,380 | 5/1984 | Moriya et al. | 340/64 X |
| 4,463,340 | 7/1984 | Adkins et al. | 307/10 AT X |
| 4,477,806 | 10/1984 | Mochida et al. | 361/171 X |
| 4,486,806 | 12/1984 | Mochida et al. | 361/172 |
| 4,488,056 | 12/1984 | Mochida | 361/172 X |
| 4,492,959 | 1/1985 | Mochida et al. | 361/172 X |

*Primary Examiner*—William M. Shoop, Jr.
*Assistant Examiner*—Shik Luen Paul Ip
*Attorney, Agent, or Firm*—Bucknam and Archer

[57] ABSTRACT

The composite automatic control system for vehicle engine with theft prevention circuit serves the purpose of controlling the door lock and engine starting power supply. It comprises present correct keys $S_1$, $S_2$, $S_3$ and error keys $S_4$, $S_5$. . . $S_{10}$. Decoding of the system depends upon the pressing of keys in a sequential order of $S_1$, $S_2$, $S_3$ at predetermined time intervals, for instance 5 seconds as set forth in the model circuit. Failure to do this within the time limit causes the previous input signal to be entirely nullified. The alarm is then triggered to prevent theft upon improper sequence of correct keys or input of error keys.

5 Claims, 4 Drawing Figures

COMPOSITE AUTOMATIC CONTROL SYSTEM FOR VEHICLE ENGINE WITH THEFT PREVENTION CIRCUIT

The present invention relates in general to a composite automatic control system for vehicle engine with theft prevention circuit and more particularly to a control circuit system controlling both the door lock as well as the engine starting power supply so as to trigger an alarm when the operation fails to obey the predetermined sequence or procedure.

The automobile has been a most popular and convenient transportation means nowadays. However, theft of cars has also been a drawback. Various means have been devised to prevent such crime from occuring, however, few devives have been proved successful. Traditional mechanical locks are likely to be opened and temporary wiring has also caused the car to be easily stolen. Among the known devices, three typical categories are commonly seen: a microswitch on the door or the engine compartment hood is not satisfactory because usually the alarm is not triggered until the door or hood is opened. Besides, the contacts of the switch may fail to work due to bad connection. By providing micro sensors, the drawback is that the sensitivity of the sensor can hardly be adjusted to a proper extent and an over sensitive sensor would cause a false alarm when there is a gust of strong wind or when somebody leans upon the car. If the sensor is insufficiently adjusted, the alarm fails to sound when the car is already in motion. By the use of an infrared beam detector, not only the complexity and high cost become a drawback, but the socalled "Exit delayal" as provided would allow the intruder to cut the alarm or steal the property in the vehicle.

The present invention as herein disclosed is a result of diligent study of the aforesaid problems with the advantages of easy operation with sure effect. The circuit system prevents the car from theft, gives no chance for picking the lock or destroying it, the alarm being falseproof and sure firing. Therefore it is a novel idea of a composite automatic circuit and theft prevention system and besides, the owner can operate it without bringing a key.

The present invention is described in detail by reference to the accompanying drawings, of which:

Figure 1:
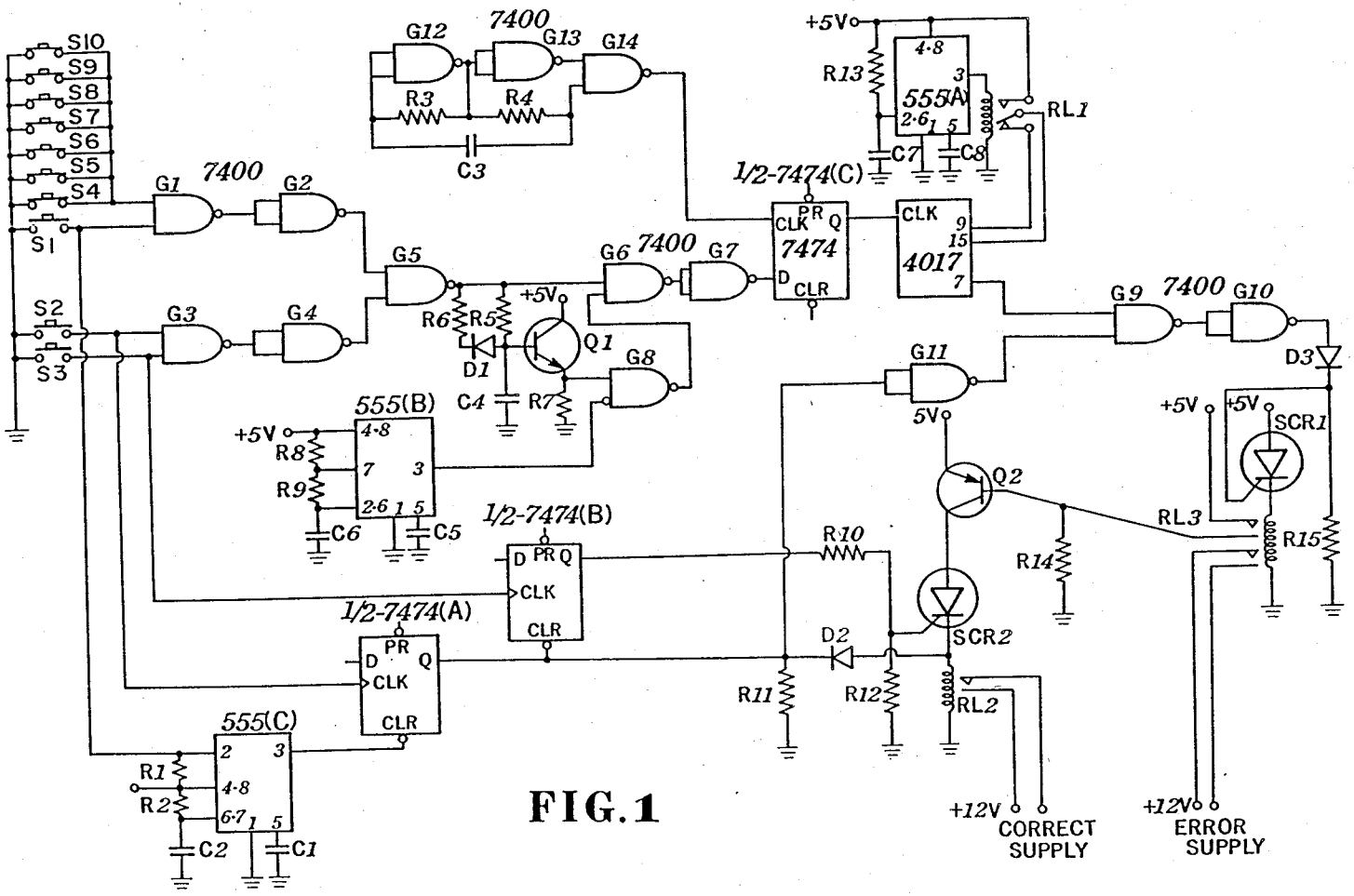
FIG. 1 shows a control and theft prevention circuit for decoding a secret coded door opening or engine starting system according to one embodiment of the present invention.

Now with reference to FIG. 1 for the illustration of the functions of the integrated circuit units related in this embodiment:

IC 555: Three IC 555 are used in the circuit, designated respectively as 555(A), 555(B) and 555(C).

555(A) is designed as an individual timer. When power is on, it generates an oscillating wave with a width of $T=1.1RC$ sec. at output terminal (leg No. 3). After a predetermined time of T sec. (0.5 sec. in this example), the impulse vanishes. Since the high frequency noise generated upon application of power source, would trigger the silicon controlled rectifier SCRI through an IC 4017, causing the alarm to sound, by way of No. 3 leg of 555(A), the reset terminal (leg No. 15) is reset in time, so that the noise signal is not allowed to output from IC 4017.

555(B) is a pulse generator, with frequency of $f=1/(R_8+R_9)C_6=6$. With the keys umpressed, the output at gate $G_5$ is of low potential (0), the pulse generated by 555(B) reaches $G_7$ through $G_8$, $G_6$ maintains a low potential (0), so that it has no action on the circuit. Yet for the purpose of preventing the unauthorized operator from trying other keys during a long pressing of one key, it can be seen that when one of the keys is pressed for a long time, the output of $G_5$ is in high potential (1), causing the emitter of the transistor Q outputs to have a high potential (1). Thus the pulse generated by 555(B) reaching gate $G_7$ through $G_8$ and $G_6$ cannot maintain the state of low potential (0), and causes the Q terminal of IC 7474 to generate a pulse to CLK terminal of IC 4017 to trigger the alarm.

555(C) is a touch button switch. When $S_1$ is pressed, a pulse of $T=1.R_2C_2$ sec. is emitted at output terminal (leg. No. 3) of 555(C) (5 sec. as exemplified), to control the CLR (clear) function of terminal Q of IC 7474(A).

IC 4017 is a counter and upon pressing of anyone of the keys $S_1$–$S_{10}$, a pulse is generated to reach terminal CLK of IC 4017 through a series of logic gate. For every three pulses,a pulse is generated on leg. No. 7, the output pulse if it is not locked at $G_9$, $G_{10}$ (it can be locked from another input terminal of gate $G_9$ only when the correct key is pressed), triggers the silicon controlled rectifier SCRI to sound the alarm.

IC 7474(A,B): are two independent D type edge triggering flip-flop, of which the terminal CLR is of low activity. In other words, the clear terminal CLR works only at low potential, causing output of Q terminal "0", but not at high potential, and the present terminal is also in low activity. At low potential, the Q terminal is preset at "1", and inactive at high potential. In the present embodiment, the preset terminal is not connected, therefore it is in a condition of high potential, so does terminal D which is always maintained at high potential. If there is a pulse input through CLK terminal and CLR are in high potential condition, the output of Q terminal becomes "1", (i.e. high potential).

The relationship among the several parts of the unit circuit is further detailed as follows: when either one of keys $S_1$–$S_{10}$ is pressed, the low potential (0) signal becomes high potential (1) after passing through $G_1$, $G_2$ (or $G_3$, $G_4$) as well as $G_5$, $G_6$ and $G_7$, as the signal is transmitted to the terminal D of flip-flop IC 7474(C), since at CLK terminal of flip-flop there is always a pulse input generated by pulse generator formed by $G_{12}$, $G_{13}$ and $G_{14}$. Therefore the signal transmitted to the terminal D can be emitted from terminal Q to the terminal CLK of IC 4017 for counting. With every pressing of the key, the counter increases 1 count, when reaching 3 counts, impulse outputs from No. 7 leg of 4017, if they are not locked up at $G_9$, $G_{10}$,(they will be described hereinbelow),the alarm is triggered.

The pressing of correct keys and error keys makes difference. When the correct ones are pressed, not only the counter pulses 1, but starting 555(C) and 1/2-7474(A), 1/2-7474(B) in the meantime, i.e. simultaneous to the pressing of $S_1$, it triggers the input terminal (leg No. 2) of 555 (C) to generate a pulse having a width of 5 sec. This high potential pulse causes defunction of CLR of 1/2-7474(A). Then key $S_2$ is pressed, so that a pulse is emitted to CLK terminal of 1/2 7474(A), since this CLR terminal has been defunctioned and the D terminal is at high potential as a result of non-connection. The pulse input to CLK imparts to the Q terminal a high potential which again defunctions the CLR of 1/2-7474(B).

When key $S_3$ is subsequently pressed, a pulse is emitted to terminal CLK of 1/2 7474(B). For the same reason, this pulse causes Q terminal to become a high potential, so that it triggers $SCR_2$ to conduct relay $RL_2$. Power is supplied to open the door lock. If this circuit is designed for starting control of the engine, power will be supplied to the engine as hereinafter described.

When the predetermined time limit (5 sec. in the FIG. 1 embodiment) is exceeded and the decoding operation has not yet been effected, the output pulse from 555 (C) vanishes and the low potential is resumed. The CLR of 1/2 7474(A) refunctions, causing Q terminal to "0" potential, which in turn resumes CLR of 1/2-7474(B). The Q terminal of 1/2 -7474(B) becomes "0", therefore, if the pressing of $S_1$, $S_2$, $S_3$ is not finished within the time limit, not only $SCR_2$ is not triggered but the three pressing operations would then cause the output of IC 4017, and the pulse will trigger $SCR_1$ to emit an alarm, so that any trial could be prevented.

Upon pressing of $S_1$, $S_2$, $S_3$ in time, IC4017 counts just likewise to 3 and outputs a high potential (1). Yet the Q terminal of flip-flop 1/2-7474 (A) generates high potential in the meantime, which is outphased through $G_{11}$ to become low potential (0). The two input signals ("1" and "0") form a high potential (1) at gate $G_9$ and are out-phased to form a low potential through $G_{10}$ and $SCR_1$ is incapable to trigger the alarm.

Therefore, only by pressing three correct keys in proper sequence and within limited time, the lock can be opened, otherwise, the alarm is triggered. When one who does not know the predetermined correct key numbers but tries to open the lock, the possibility that he will be successful, is practically zero. The design of the present invention provides the effect which no other known devices in the prior art ever achieved.

Figure 2:
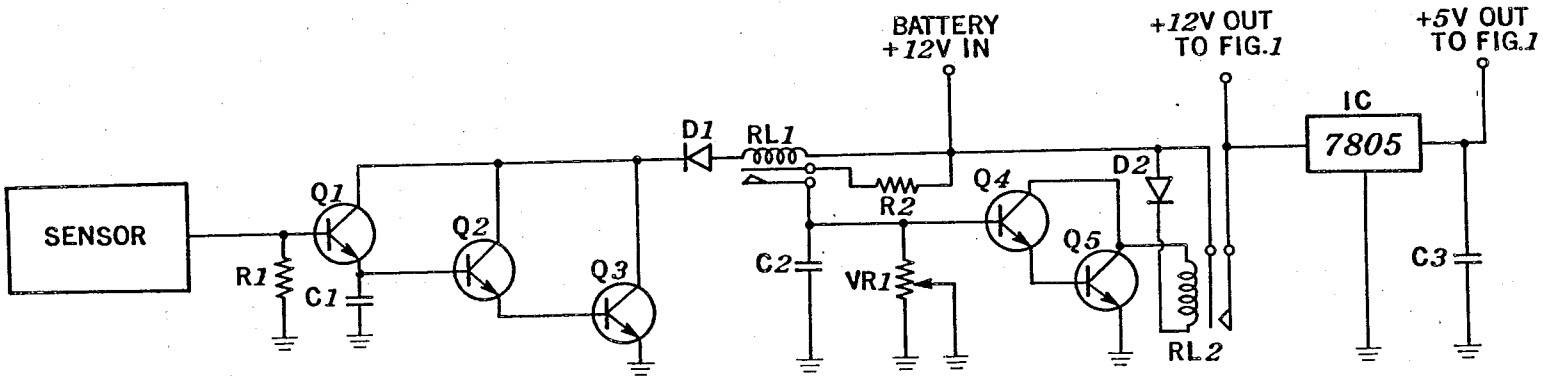
FIG. 2 is a sensing type control circuit for automatic control of power supply for the system of FIG. 1.

For the assurance of the durability of circuit parts and the simplification of the automation, a sensor type circuit for automatic control of power supply such as shown in FIG. 2 is provided. If it is desired to open the door with one touch of the sensor, power is supplied immediately for the decoding circuit,for instance 10 seconds (length of time is adjustable) then the source is automatically cut off. The sensor in the circuit is ready to be connected to a 12 v. battery at any time, transistors $Q_1$–$Q_5$ constitute the main body of the touch type delay switch, static induction of human body is utilized to trigger $Q_1$, amplified by $Q_2$ and $Q_3$, rectified by diode $D_1$ and drives to the relay $RL_1$, so as to drive the post stage delaying circuit. When $RL_1$ is actuated, capacitor $C_2$ is charged, the post-stage capacitor starts discharging as soon as the saturation is reached, post stage $Q_1$, $Q_2$ serve as post-stage amplifier, output of which drives $RL_2$ to supply power for the purpose of the decoding circuit of FIG. 1.

Figure 3:
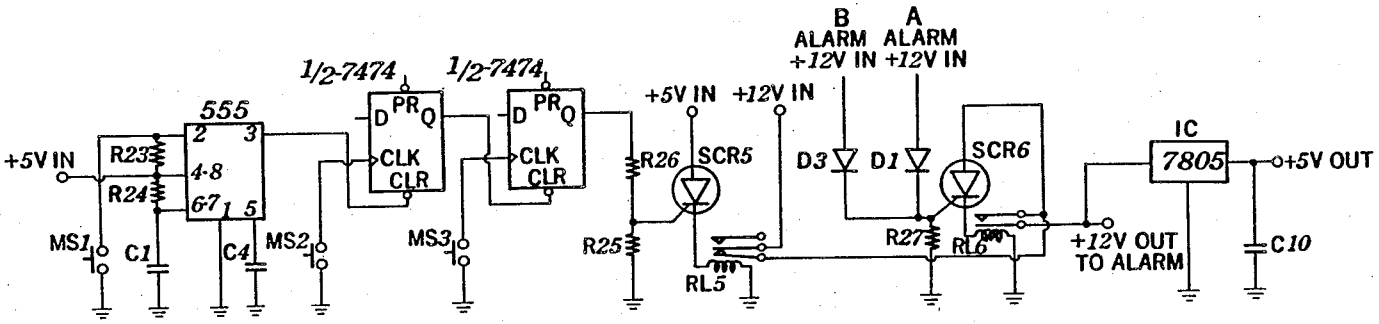
FIG. 3 is a control circuit for alarm stop in the system of FIG. 2.

FIG. 3 is a control circuit for stopping of alarm, such as mentioned in FIG. 1. The improper operation triggers $SCR_1$ to drive relay $RL_3$. "Alarm A+12 V in" terminal of the stopping circuit (see FIG. 3) connects to the power source and $SCR_6$ is triggered to drive relay $RL_6$. Unless the stopping circuit is closed by this time, the alarm would keep on and on. The alarm stopping circuit of the present invention is composed of IC 555 and IC 7474, the operation of which is as follows: IC 555 is a touch type switch. When switch $MS_1$ is on, the No. 3 leg of IC 555 emits a pulse signal to the CLR terminal of the next stage IC 7474, then the switch $SM_2$ is on, the output terminal Q of IC 7474 also provides a pulse to the CLR terminal of the next stage IC 7474, by pushing switch $MS_3$. The output terminal Q of the last stage IC 7474 then generates a pulse to trigger $SCR_5$, driving relay $RL_5$ to interrupt the power supply to the alarm.

Figure 4:
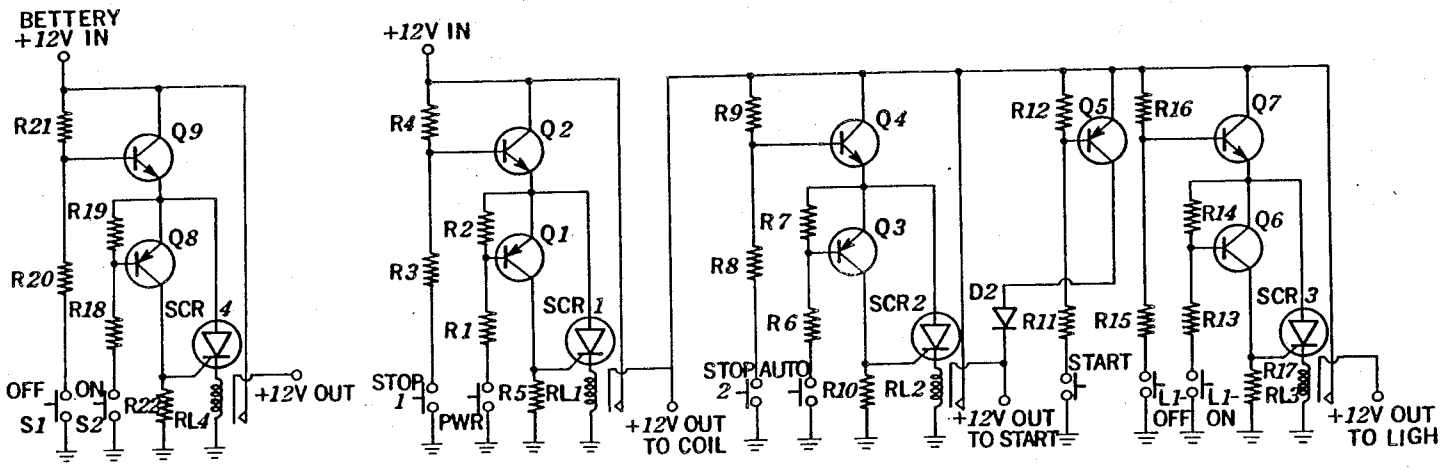
FIG. 4 is a composite control circuit for the engine and headlight power source.

FIG. 4 is a control circuit of engine and headlight power supply for the use with the circuit mentioned in FIG. 1. When proper decoding is effected to the FIG. 1, voltage of 12V battery is applied to the collector of top left transistor $Q_9$ in FIG. 4. When switch $S_2$ is closed by this moment, $SCR_4$ is conducted to drive relay $RL_4$, the 12 v-voltage is then fed to the next stage decoding circuit for the purpose to start the engine ignition coil, the engine starting the headlight of the car. In case of improper input (not shown), this decoding circuit would output a pulse to diode $D_1$ (see FIG. 3), then would trigger to cause the condition of relay $RL_6$ and actuate the alarm. As for the next stage control circuit for ignition coil, formed by $SCR_1$, transistor $Q_1$, $Q_2$ and $RL_1$, when the previous stage accepts the correct code, it inputs the 12 V voltage to the collector of transistor $Q_2$, If the power supply switch PWR is closed by this time, resistor $R_1$ is grounded, transistor $Q_1$ is properly biased and conducted, the conduction of $Q_1$ causes the conduction of $Q_2$ in turn, triggers $SCR_1$ and drives relay $RL_1$ at the same time, the car is totally supplied with power as required by the respective load. When the STOP switch is pushed, resistor $R_3$ is grounded, $Q_2$ being interrupted, $SCR_1$ and $RL_1$ are subsequently cut off and the power supply is terminated. As for the engine starting and headlight control, the structure, the operation characteristics are all the same and therefore will not be described further.

The composite automatic control system for vehicle engine with theft prevention lock circuit as disclosed above is highly effective in theft prevention. The owner can operate it without bringing a key, and it is both reliable and convenient.

What is claimed is:

1. A composite automatic control system for theft prevention of a vehicle comprising a secret coded locking circuit including:

(a) A plurality of manually operated switches;

(b) first pulse generating circuit means connected to said plurality of switches whereby one pulse is generated at the output of the first pulse generating circuit means each time when any one of the switches is operated;

(c) counter means connected to the output of the first pulse generating circuit means to count the number of the output pulses whereby an output of logic HIGH signal is provided each time when a count of predetermined number of pulses is reached;

(d) timing circuit means and second pulse generating circuit means connected to a predetermined number of switches preselected from said plurality of switches whereby the second pulse generating circuit means provides an output of logic HIGH signal to enable an electrically controlled device to be operated with DC power only if said predetermined number of preselected switches are operated in a predetermined sequence within a predetermined time interval, the number of preselected switches being equal to said predetermined number of pulses; and (e) judging circuit means connected to the output of said counter means and to the output of said second pulse generating circuit means whereby the judging circuit means provides an output of logic HIGH signal to enable an alarm device to be operated with DC power and at the same time disable the electrically control device unless the output of said counter means and the output of said second pulse generating means are both of logic HIGH signal.

2. A composite automatic control system according to claim 1, wherein the electrically controlled device is a motor vehicle ignition circuit device.

3. A composite automatic control system according to claim 1, wherein the electrically controlled device is a vehicle door locking circuit device.

4. A composite automatic control system according to claim 1, wherein the total number of said plurality of switches is 10 and the total number of said preselected switches is 3.

5. The control system according to claim 1, which comprises a touch type automatic control circuit for power supply.

* * * * *